United States Patent [19]

Conti

[11] Patent Number: 4,623,956

[45] Date of Patent: Nov. 18, 1986

[54] RECESSED ADJUSTABLE LIGHTING FIXTURE

[76] Inventor: Mario W. Conti, 7044 Estrella de Mar Rd., Carlsbad, Calif. 92008

[21] Appl. No.: 609,283

[22] Filed: Aug. 6, 1984

Related U.S. Application Data

[63] Continuation of Ser. No. 317,480, Nov. 2, 1981, abandoned.

[51] Int. Cl.[4] ..... F21S 1/02

[52] U.S. Cl. ..... 362/148; 362/273; 362/287; 362/364; 362/428

[58] Field of Search ..... 362/147, 273, 296, 364, 362/366, 371, 404, 427, 428, 432, 297, 341, 346, 145, 148, 269, 287, 289, 418; 403/DIG. 9, 87; 24/274 R, 274 P, 279 WB

[56] References Cited

U.S. PATENT DOCUMENTS

| | | | |
|---|---|---|---|
| 2,510,892 | 6/1950 | Kennelly | 362/273 |
| 2,855,503 | 10/1958 | Gerstel | 362/273 |
| 3,267,802 | 8/1966 | Noble | 362/268 |
| 3,396,439 | 8/1968 | Schaub | 24/274 P |
| 3,643,089 | 2/1972 | Marantz | 362/296 |

FOREIGN PATENT DOCUMENTS

| | | | |
|---|---|---|---|
| 46909 | 3/1911 | Fed. Rep. of Germany | 362/296 |
| 369955 | 12/1935 | Fed. Rep. of Germany | 362/296 |

OTHER PUBLICATIONS

IES Lighting Handbook, 1981 Application Volume, Chapter 10, pp. 19–20.

*Primary Examiner*—Craig R. Feinberg
*Assistant Examiner*—David A. Okonsky
*Attorney, Agent, or Firm*—Edgar W. Averill, Jr.

[57] ABSTRACT

A recessed adjustable lighting fixture for general purpose illumination. The fixture has a base member which may be held against a wall or ceiling, and the major components of the fixture are recessed behind the base member. The lamp is held behind the base by a tiltable platform which is moved by turning a worm gear which cooperates with a curved strap to permit adjustment of the tilt of the lamp assembly.

12 Claims, 8 Drawing Figures

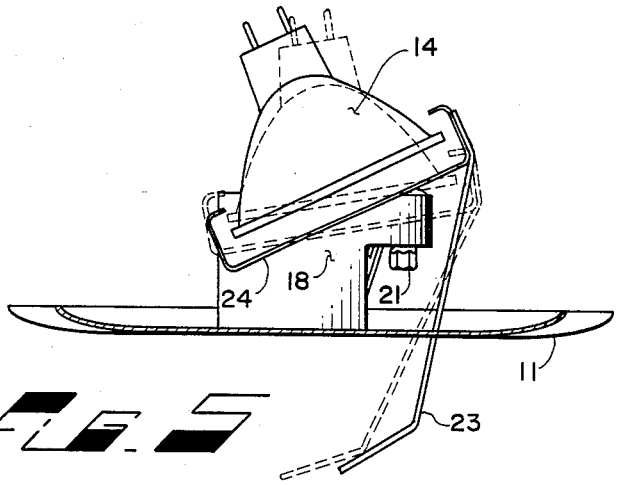
FIG. 5
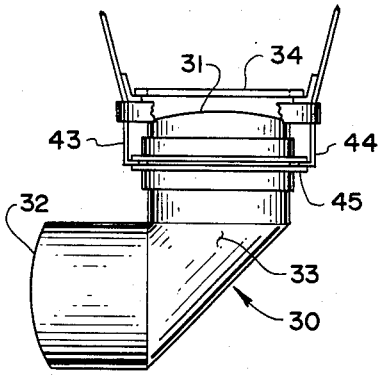
FIG. 7
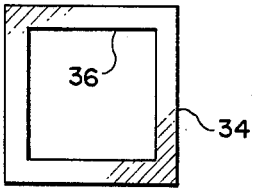
FIG. 8
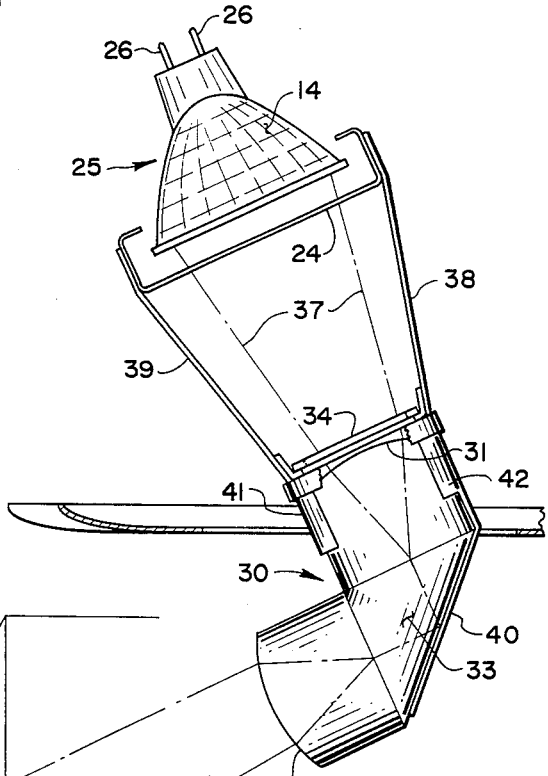
FIG. 6
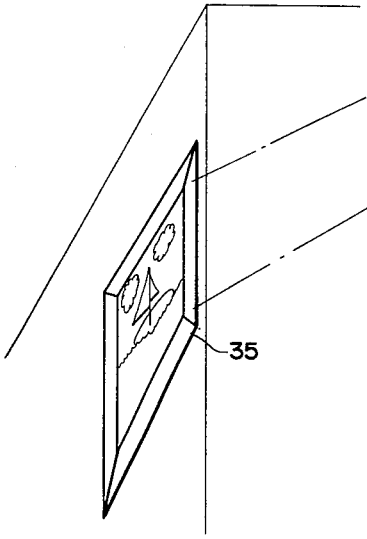

RECESSED ADJUSTABLE LIGHTING FIXTURE

This is a continuation, of application Ser. No. 317,480, filed 11/02/81 and now abandoned.

BACKGROUND OF THE DISCLOSURE

The field of the invention is illumination devices, and the invention relates more particularly to recessed adjustable lighting fixtures which may be placed in a ceiling or wall and adjusted to illuminate a desired area of the room.

Various tilting light fixtures are commonly used and the following patents disclose lighting fixtures of this general type: U.S. Pat. Nos. 2,855,503; 3,609,346; 3,693,000; 2,218,395; 2,003,342; 4,177,504; 4,237,528; 3,944,810; 3,284,624; 3,312,816 and 3,381,125.

Each of the above-listed patents disclose devices which have various shortcominings, and there is a need for a fixture which may be accurately adjusted while being recessed in a wall or ceiling. Many tilting light fixtures are limited in degree of tilt and exhibit a loss of light near the extremities of tilt.

A particularly difficult lighting application is the illumination of a part of a wall by the use of a fixture mounted in a ceiling. This type of illumination is typically referred to as a "wall washer" and is widely used in retail stores, art galeries and in residential homes. Such illumination may be even more closely controlled to illuminate a single painting where the light is focused in the shape of the painting and is generally referred to as a framing projector. Framing projectors typically have required extensive optics and typically have required lighting fixtures which could not be recessed, but instead were mounted on a rack or otherwise protruding from the ceiling. Framing projectors typically cost in excess of $500 and are about 12 inches in length. Because of their size, they are difficult or impossible to conceal.

There is thus a need for a simple and yet accurately controlled recessed adjustable lighting fixture.

SUMMARY OF THE INVENTION

It is an object of the present invention to provide a recessed adjustable lighting fixture which may be adjusted while recessed and tilted to a desired angle.

The present invention is for a recessed adjustable lighting fixture for general purpose illumination. The fixture has a base member which may be attached to a wall or ceiling. A tiltable platform is tiltably affixed to the base memeber and the lamp assembly is held on the tiltable platform. A curved strap having a plurality of slots formed therein is affixed to the platform and the center of curvature of the strap is located at about the pivot point of the tiltable patform. A worm gear having teeth extending through at least one slot of the curved strap is held to the base member. When the worm gear is turned, the platform tilts. In a preferred embodiment, the tilting lamp fixture has reflective means such as a mirror or prism attached to the tilting platform to direct the light in a 90 degree angle from the axis of the lamp assembly. The reflecting means may further include lens means for focusing the light.

BRIEF DESCRIPTION OF THE DRAWINGS

FIG. 5 is a cross-sectional view of the fixture of FIG. 1.

FIG. 6 is a cross-sectional side elevation of an alternate embodiment of the fixture of FIG. 1.

FIG. 7 is a side-elevatinal view of an alternate embodiment of a holding member of the prism of the fixture of FIG. 6.

FIG. 8 is a plan view of a mask comprising a portion of the lamp assembly of FIG. 6.

DESCRIPTION OF THE PREFERRED EMBODIMENTS

Figure 1:
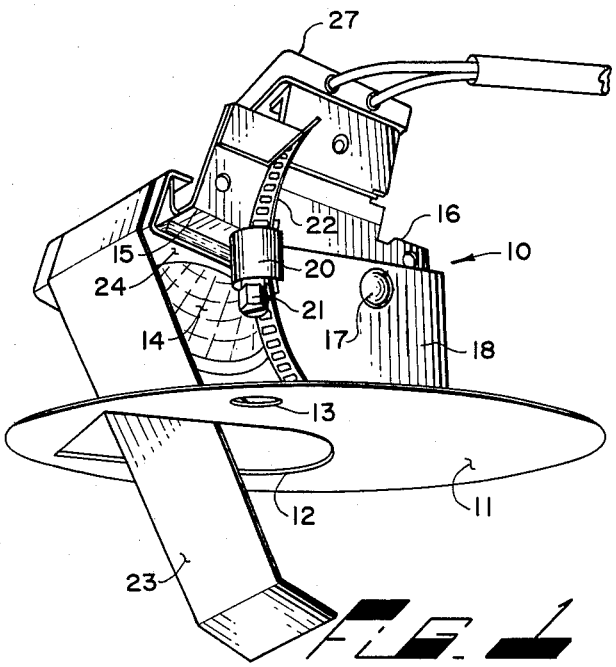
FIG. 1 is a perspective view of the fixture of the present invention.

A recessed adjustable lighting fixture has a base member 11 which is placed against a ceiling or wall in a conventional manner. Base member 11 has an opening 12 through which the light passes and also has an opening 13 to permit adjustment of the tilt of the lamp as more fully set forth below. A portion of the lamp assembly, namely the reflector 14 is shown in FIG. 1. Reflector 14 is held to a platform 15 which has a vertical potion 16 which pivots about a rivet 17. Rivet 17 is held in a plate 18 which is affixed to base member 11.

A worm gear assembly 20 is also held to plate 18 and has a screw 21 which is accessible through opening 13. Screw 21 has a worm gear shaft which cooperates with a strap 22 which contains a plurality of slots. Strap 22 is welded or otherwise affixed to the vertical portion 16 of platform 15. Thus, by turning screw 21, platform 15 is tilted with respct to base 11.

Figure 2:
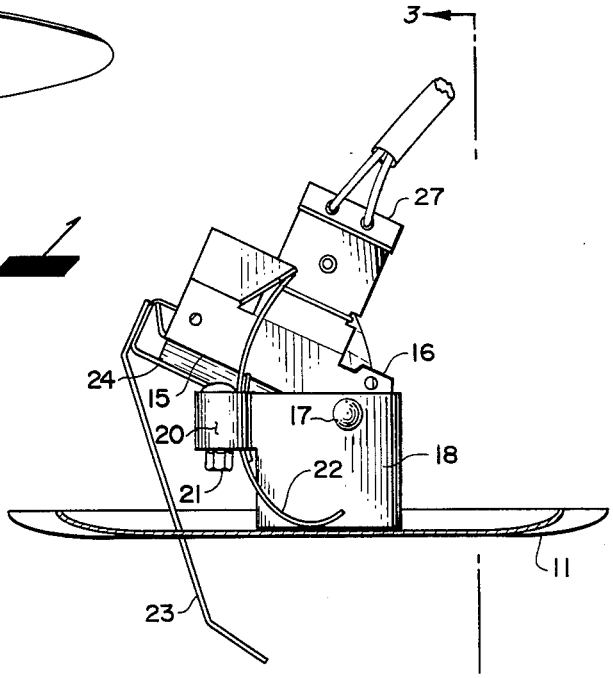
FIG. 2 is a side-elevational view partly in cross section of the fixture of FIG. 1.
Figure 3:
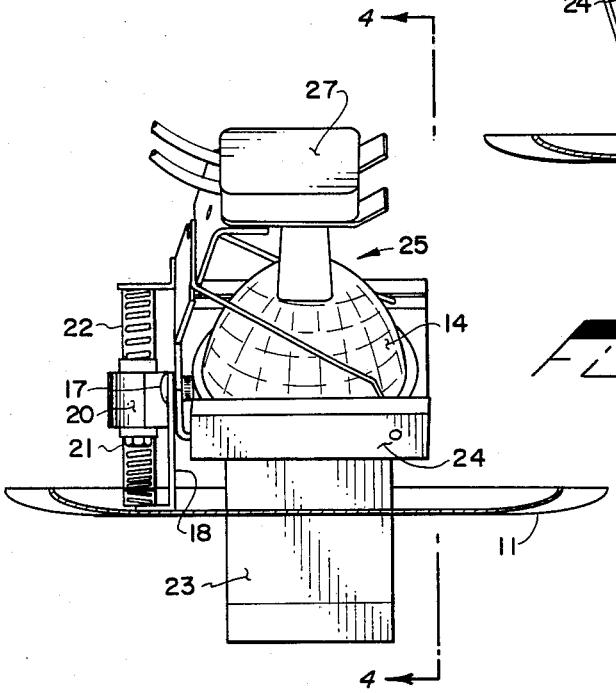
FIG. 3 is a cross-sectional view taken along line 3—3 of FIG. 2.
Figure 4:
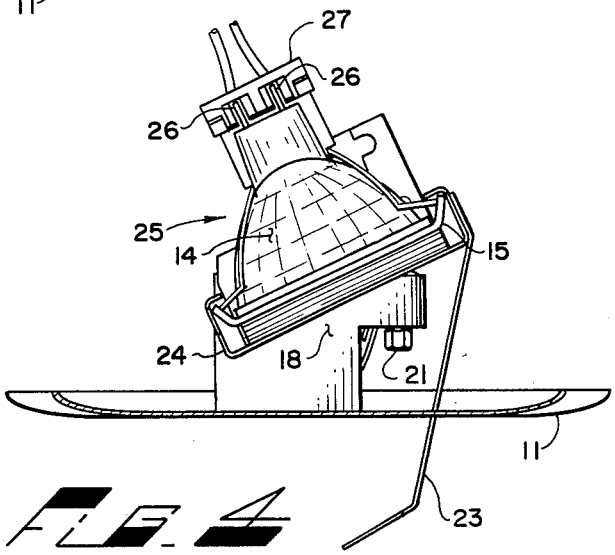
FIG. 4 is a cross-sectional view taken along line 4—4 of FIG. 3.

A reflecting mirror 23 is riveted to a lens holder 24 which is held on platform 15. This attachment may more readily be seen in FIGS. 2 and 4. Mirror 23 thus moves with platform 15 and is held in a fixed position with respect to reflector 14 and the lamp assembly.

The lamp assembly 15 includes a bulb (not shown). The reflector 14 and a pair of pins 26 are inserted through slots in socket 27 in a conventional manner. Lamp assembly 25 is commercially available and is preferably of the type which has a dichroic reflector which permits the ultraviolet and infra-red to pass through the wall of the reflector 14 and yet the vast majority of the visible light is relfected from the dichroic mirror toward mirror 23. The lamp should be of the type which has a controlled beam path where all the light passes through a relatively small spot. The mirror should be fixed at this spot so that a relatively small mirror or prism can reflect substantially all the light emitted from the bulb.

For both safety and optical reasons, it is often desirable to place a lens against the face of reflector 14. The present assembly permits the insertion of such a lens between lens holder 24 and platform 15 and is shown best in FIG. 4. The lens may be simply a clear piece of glass or other transparent member or instead may have a surface which causes the light to diffuse.

Mirror 23 is preferably held at approximately a 45 degree angle with respect to platform 15 and thus as the lamp is tilted, the light path becomes approximately horizontal when platform 15 is horizontal. Thus, it is possible to illuminate a portion of the wall very near the ceiling while the lamp assembly itself is still completely recessed and only a portion of the mirror protrudes below the ceiling. As shown in FIG. 5, the further downward tilt of the lamp assembly as shown by the phantom lines causes the light rays to be directed higher on a wall.

Mirror 23 should be placed near the focal point of lamp assembly 25 so that the vast majority of the light emitted from the lamp assembly is reflected by the mirror. Mirror 23 may be made from a reflective material such as polished aluminum or may instead be a conventional mirror made from metallic coated glass.

It is possible to combine focusing and reflecting functions in a single optical member. This is shown in FIG. 6 where the optical member is indicated generally by reference character 30 which has a pair of lenses 31 and 32 and a prism 33. This combination permits the light beam to be focused on a wall to create a framing projector. When combined with a mask 34, the light image may be any shape such as a square or rectangular, depending upon the opening in the mask, and a painting 35 may accurately be illuminated by selecting a mask of the proper size and shape.

A mask 34 is shown in FIG. 8 which has a square opening 36 cut therein. If other shapes are desired, the shape of opening 36 should be made to conform with the desired end shape.

As shown best in FIG. 6, the light rays 37 eminating from lamp assembly 25 are directed toward prism 33 and are further directed by lens 31. Prism 33 deflects the light rays in a right angle and they are again passed through lens 32 toward the object 35 to be illuminated. Optical member 30 is held by a bracket assembly including arms 38 and 39 which hold a prism holding platform 40 and lens holding members 41 and 42. An alternative optical member holder is shown in FIG. 7 where two semi-circular brackets 43 and 44 fit into a slot in ring 45 which is held by an adhesive to optical member 30. This permits the rotation of optical member 30 to further permit direction of the light rays eminating from the fixture.

The term "mirror" as used in this specification is intended to include other reflective devices such as prisms. The word "lens" is intended to be used in its broadest sense and includes not only conventional lenses but fresnel lenses.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A recessed, adjustable, lighting-fixture for general purpose illumination, said fixture comprising:

a base member for attachment to a static structure, said base member having an opening therethrough for the passage of light;

a platform affixed to the base member;

a lamp assembly including a bulb and a reflector affixed to the platform, said lamp assembly having a convergent, controlled light beam path where substantially all the light passes through said opening; and reflecting means mounted at an angle of about 45 degrees with respect to the light beam path, said reflecting means being attached to the platform in such a position that it will adjustably protrude through the opening in the base member and being positioned so that it reflects the controlled light beam path, said reflecting means being located near a focal point of said reflector.

2. The lighting fixture of claim 1 wherein said reflecting means comprises a mirror.

3. The lighting fixture of claim 1 wherein said reflecting means is a prism.

4. The lighting-fixture of claim 1 wherein said platform is tiltably affixed to said base member.

5. The lighting fixture of claim 4 further including a curved strap having a first end and a second end, said curved strap being affixed at its first end to said platform and having a plurality of slots formed therein, the second end of said curved strap being free, the center of curvature of the strap being at about the pivot point of the tiltable platform; and a worm gear assembly held to the base member, said worm gear assembly having teeth extending through at least one slot of said curved strap whereby the turning of the worm gear tilts the platform with respect to the base member.

6. The lighting fixture of claim 5 wherein the worm gear has means for attachment for screwdriver means.

7. The lighting fixture of claim 5 wherein the base member has an opening to permit the insertion of a screwdriver blade therethrough.

8. The lighting fixture of claim 5 further including a lens member held to said platform.

9. The lighting fixture of claim 5 wherein the platform is affixed to the base by way of a vertical support plate affixed to the base member.

10. The lighting fixture of claim 9 wherein the worm gear is held to the vertical plate.

11. A recessed, adjustable, lighting-fixture for general purpose illumination, said fixture comprising:

a base member for attachment to a static structure, said base member having an opening therethrough for the passage of light;

a platform affixed to the base member;

a lamp assembly including a bulb and a reflector affixed to the platform, said lamp assembly having a convergent, controlled light beam path where substantially all the light passes through said opening; and reflecting means mounted at an angle of about 45 degrees with respect to the light beam path, said reflecting means being attached to the platform in such a position that it will protrude through the opening in the base member and being positioned so that it reflects the controlled light beam path and wherein said reflecting means comprises an optical member having a first lens affixed to a prism and a second lens affixed to said prism whereby the light is focused, reflected at a right angle and emitted from the optical member.

12. The lighting fixture of claim 11 further including an optical mask held between said lamp assembly and said optical member.

* * * * *